United States Patent [19]

Newman et al.

[11] 4,048,694

[45] Sept. 20, 1977

[54] HYDRAULIC DOOR CLOSER WITH ADJUSTABLE TIME DELAY DAMPENER

[75] Inventors: Donald John Newman, South Oakleigh; Gerald Francis Dunphy, Glen Waverley, both of Australia

[73] Assignee: Ogden Industries Pty. Limited, Australia

[21] Appl. No.: 662,368

[22] Filed: Mar. 1, 1976

[30] Foreign Application Priority Data

Mar. 7, 1975 Australia ..... 0826/75

[51] Int. Cl.[2] ..... E05F 3/10; E05F 3/12

[52] U.S. Cl. ..... 16/52; 16/DIG. 21

[58] Field of Search ..... 16/51, 52, DIG. 21

[56] References Cited

U.S. PATENT DOCUMENTS

| | | | |
|---|---|---|---|
| 2,586,135 | 2/1952 | Woodruff | 16/51 |
| 2,688,150 | 9/1954 | Roussel | 16/52 |
| 3,079,629 | 3/1963 | Millard et al. | 16/52 |
| 3,875,612 | 4/1975 | Poitras | 16/51 X |
| 3,887,961 | 6/1975 | Saajos | 16/51 X |

*Primary Examiner*—Werner H. Schroeder
*Assistant Examiner*—Conrad L. Berman
*Attorney, Agent, or Firm*—Graybeal, Barnard & Uhlir

[57] ABSTRACT

A door closer of the kind having a piston slidably mounted in a bore containing hydraulic fluid and dividing that bore into damping and reservoir chambers. Drive means is connected to the piston to respond to sliding movement of the piston and translate that into rotary motion for driving door connected linkage. The piston is spring influenced in a direction towards the damping chamber, and fluid pressurized by the piston tending to move in that direction bleeds from the damping chamber through an escape port which is controlled by a biased and movable closure member. Normally the closure member is biased into a rest position in which it blocks passage of fluid through the escape port, but it responds to fluid pressure in the damping chamber to move into an open position at which fluid can bleed through the escape port. The time taken for the closure member to travel from the rest to the open position is a delay time during which the piston is freed from external influence so as to be movable in a door closing direction, but is temporarily restrained against such movement by the closure member. That delay time can be varied by adjusting the rest position of the closure member and/or by adjusting the rate of fluid flow from the escape port to the reservoir chamber.

14 Claims, 10 Drawing Figures

A
B

HYDRAULIC DOOR CLOSER WITH ADJUSTABLE TIME DELAY DAMPENER

This invention relates to closer units of the kind used to automatically close a door, gate, or similar movable member. For convenience the units will be hereinafter referred to as door closers, but that identification is not to be understood as limiting the application of such units to doors. Thus, in this specification, the word "door" is to be interpreted as embracing gates and other similar members normally mounted for movement between open and closed positions.

Door closures of the kind to which the invention relates includes a piston or similar member slidable within a closer body and driven in a door closing direction by a spring. In use, the piston is operably connected to drive means which responds to movement of the piston in the door closing direction so as to cause closing movement of an associated door. Hydraulic fluid is used to dampen movement of the piston in the door closing direction, and valve means is usually provided to permit some adjustment of the degree of retardation imparted by the hydraulic fluid to piston movement in the door closing direction.

Closer units of the foregoing kind enter into a door closing operation most immediately the associated door is released from an opening or stopping influence. In some applications, such as use on hospital doors, there is a need for a delay between removal of the aforementioned influence and commencement of closing movement of the door. Prior to the present invention, such delayed action closures were generally constructed so that the delay facility became operative only after the associated door had been moved through a particular distance (e.g. in some hinged door applications, 70° from the fully closed position), and that is not always satisfactory and can be dangerous.

It is a principal object of the present invention to provide a door closer which incorporates means for delaying closing movement, which is operative irrespective of the position at which the closer piston commences its closing movement.

In closer units of the kind under consideration, the piston is slidable within a bore of the body and divides that bore into two primary chambers, one of which may be identified as the damping chamber and the other as the reservoir chamber. The damping chamber is at that end of the body towards which the piston moves during closing operations, and consequently hydraulic fluid must be able to escape from that chamber in order for closing movement to be possible. Broadly speaking, the invention resides in provision of means whereby that escape is delayed for a suitable period of time after the piston is released from the external influences such as to be responsive to the closing bias of the associated spring.

In particular, the escape of fluid is delayed by means which normally blocks an escape port but is movable under the influence of fluid pressure within the damping chamber so as to cause the escape port to communicate with the damping chamber and thereby allow fluid to bleed from that chamber. Such bleed of fluid in turn permits the piston to move in a door closing direction. The arrangement is such that there is a time delay between the aforementioned means initially responding to the fluid pressure, and the moment when that means causes communication between the escape port and the damping chamber to be opened.

Preferably the aforementioned delay means is in the form of a member which moves between a rest position in which it blocks communication between the escape port amd the damping chamber, and an open position in which it opens that communication. The distance travelled by the delay member in moving from the rest position to the open position, is a controlling parameter in relation to the time delay period. Adjusting means may be provided whereby the rest position can be varied and thereby cause variation in the time delay period.

It is also preferred that the delay means and the escape port which it controls, are included within a member which is detachably connected to the closer unit body and defines an end wall of the damping chamber.

The following description refers in more detail to these essential features and further optional features of the invention. To facilitate an understanding of the invention, reference is made to the accompanying drawings where these features are illustrated in preferred form. It is to be understood however, that the essential and optional features of the invention are not limited to the specific forms of these features as shown in the drawings.

IN THE DRAWINGS

Figures 1, 2, 10:
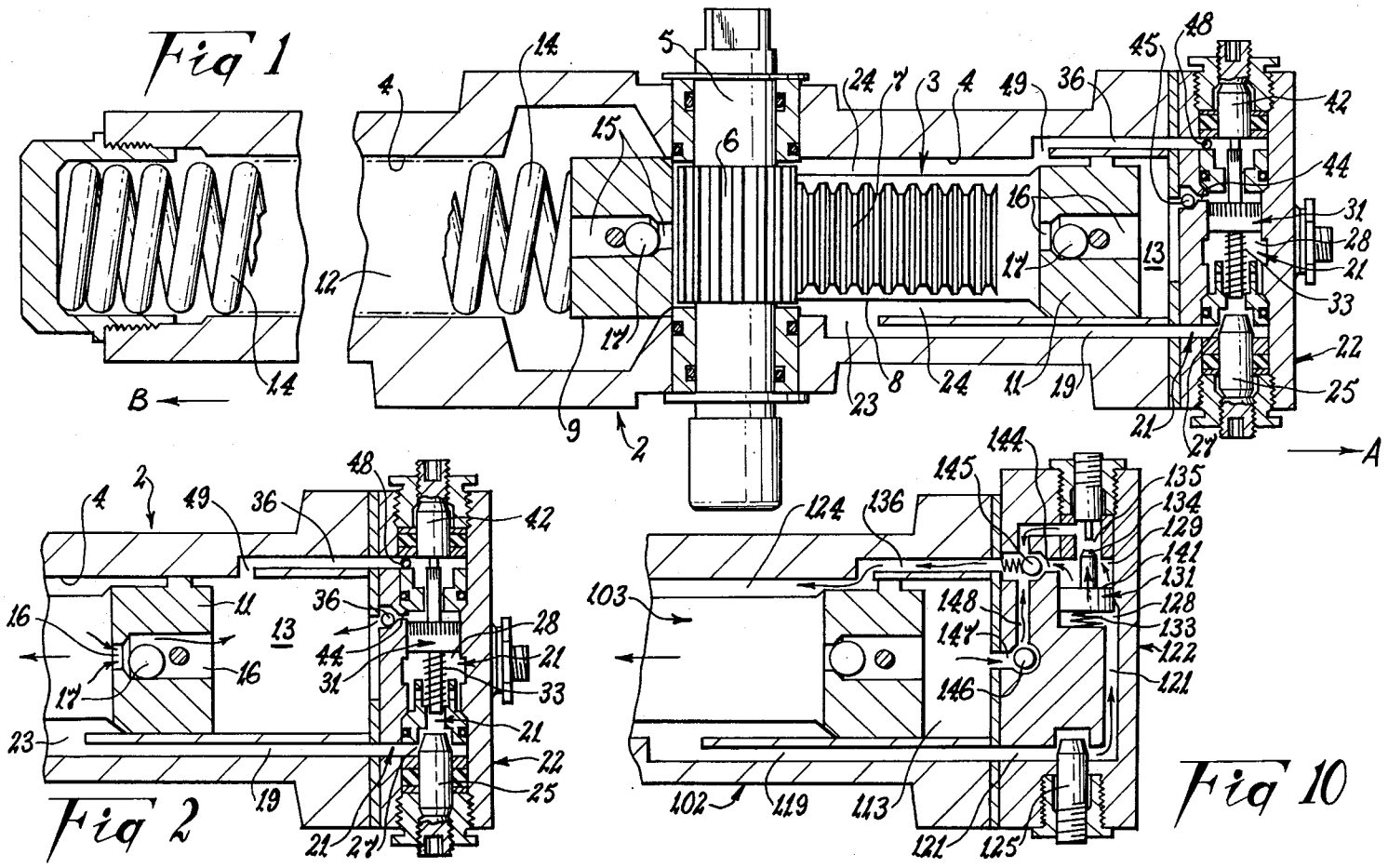
FIG. 1 is a foreshortened longitudinal cross-sectional view of one embodiment of the invention in which the unit is shown in the condition adopted when an associated door is at the fully closed position.
FIG. 2 is a view of the right hand portion of the unit shown in FIG. 1, and showing a condition of the unit at which an associated door would be partially open and is being moved into a further opened position.
FIG. 10 is a diagrammatic view of an alternative embodiment of the invention showing the unit in the condition as shown in FIG. 9.

The invention may taken any one of several forms according to the basic construction of the closer unit to which it is applied. It will be convenient however, to describe the invention as applied to one typical closer unit as shown in the accompanying drawings. With reference to FIG. 1, such a unit includes an elongated body 2 having a piston 3 slidably mounted within a longitudinally extending bore 4 of that body, and the piston 3 is connectable to a linkage system or other force transmitting means (not shown) through a drive spindle 5. Usually, in use, the body 2 is secured to a door and the force transmitting linkage is connected between the drive spindle 5 and the door jamb or an associated fixed structure.

A rack and pinion drive connection (6, 7) is provided between the piston 3 and drive spindle 5 so that the spindle 5 is rotated in response to axial movement of the piston 3. The spindle 5 extends transverse to the axis of the piston 3 and has the pinion 6 formed thereon, and the rack 7 is formed on a mid-section 8 of the piston 3. It will be appreciated however, that other drive connections may be employed.

The piston 3 has two cylindrical end sections 9 and 11 which slidably engage with the surface of the bore 4, and as previously mentioned the complete piston 3 divides the bore 4 into a reservoir chamber 12 and a damping chamber 13. A biasing spring 14 contained within the reservoir chamber 12 urges the piston 3 in a door closing direction (i.e., towards the damping chamber 13), and a valve controlled transfer passage extends longitudinally through the piston 3 to permit fluid to flow between the two chambers 12 and 13 as the piston 3 is moved axially of the bore. The transfer passage comprises two portions 15 and 16 which are respectively located in the cylindrical sections 9 and 11 of the piston 3, and a one way ball valve 17 (or other suitable means) controls each passage portion. The ball valves 17 are arranged so that during piston movement, the valve 17 at the leading end of the piston 3 is closed and the valve 17 at the trailing end is open.

During closing movement of the piston 3 (direction of arrow A in FIG. 1), fluid is transferred from the damping chamber 13 to the intermediate section 8 of the piston 3 through a valve controlled by-pass passage. In the typical construction under consideration, that passage is formed in two parts 19 and 21, which are respectively in a side wall and an end wall of the closer body 2. Preferably, as shown, that end wall comprises a valve block 22. The side wall part 19 of the passage extends lengthwise of the bore 4 so that one end 23 is in communication with the space 24 between the two piston sections 9 and 11 in all operative positions of the piston 3. The other part 21 of the passage connects with the damping chamber 13 as hereinafter described, and with the passage part 19, and as shown preferably contains a control valve 25. According to the form shown, the control valve 25 has a tapered nose 26 which cooperates with an enlarged portion of the passage part 21 to define an annular orifice 27, and the valve 25 is adjustable (e.g. through screw means) to vary the size of the orifice 27 and thereby vary fluid flow rate through the by-pass passage 19, 21.

In the particular embodiment of the present invention shown in the drawings, the escape port 28 of the delay means is formed within the by-pass passage part 21, and is formed at one end of a compartment 29 (FIG. 4) which slidably contains the pressure responsive member 31 of the delay means. The compartment 29 forms portion of the passage part 21, and has an inlet 32 (see FIG. 5) located remote from the escape port 28. As shown, the pressure responsive member 31 preferably comprises a cylindrical piston which is in substantially fluid sealing relationship with the surrounding surface of the compartment 29, and is movable axially between a rest position (FIG. 1) in which it blocks communication between the compartment inlet 32 (see FIG. 5) and the escape port 28, and an open postion (FIGS. 4 and 5) in which there is communication between the inlet 32 and the escape port 28. Biasing means in the form of a spring 33 is preferably used to urge the delay piston 31 towards the rest position.

Figure 4:
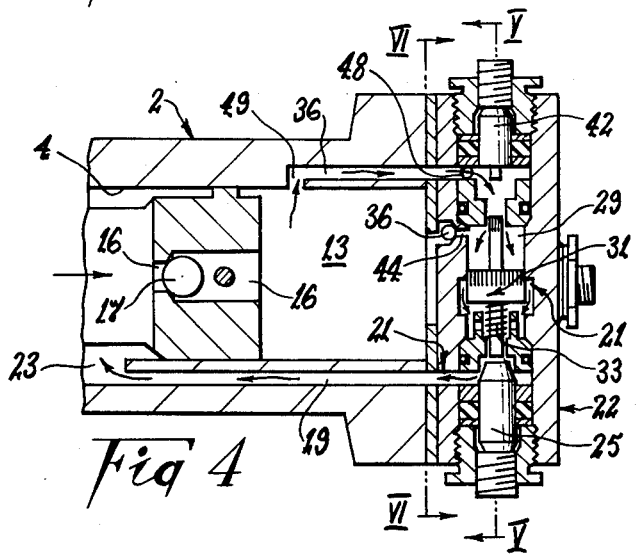
FIG. 4 is a view similar to FIG. 3 but showing the unit at the end of the time delay period which occurs between removal of the door opening influence on the unit and the moment when fluid is permitted to bleed from the damping chamber.
Figure 7:
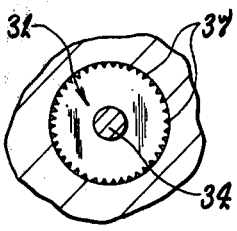
FIG. 7 is a sectional view taken along line VII—VII of FIG. 5.
Figure 5:
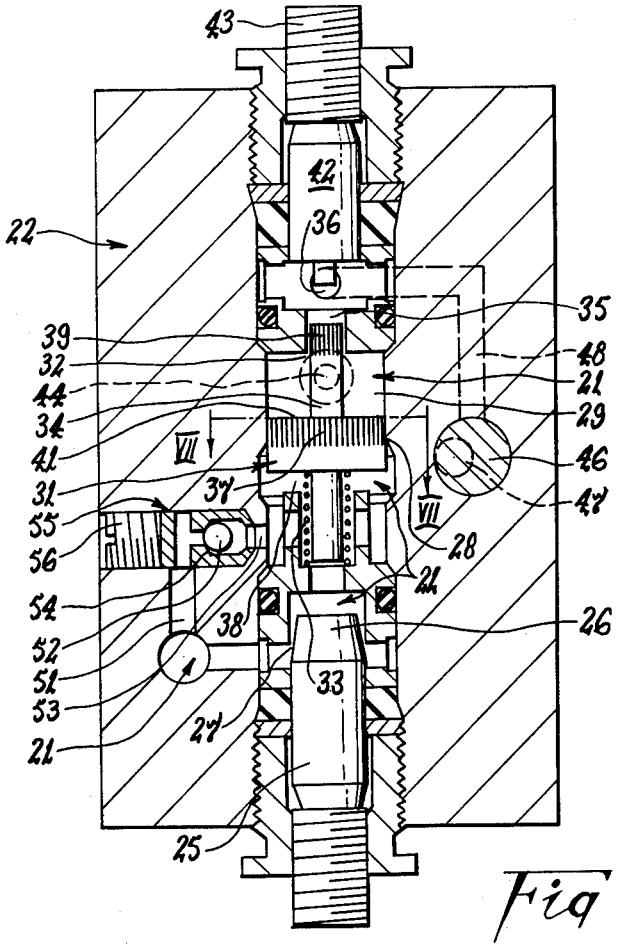
FIG. 5 is an enlarged cross-sectional view taken along line V—V of FIG. 4.
Figure 6:
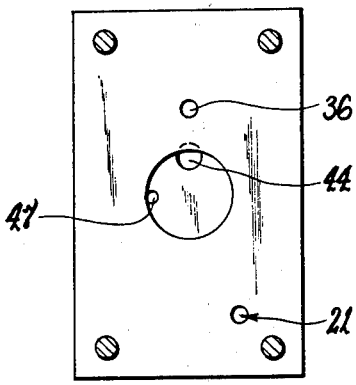
FIG. 6 is a cross-sectional view taken along line VI—VI of FIG. 4.
Figure 8:
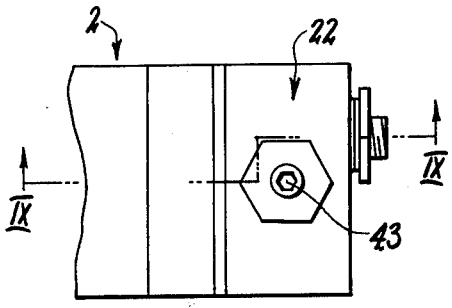
FIG. 8 is a plan view of the right hand end of the unit as shown in FIG. 1.

Referring in particular to FIG. 5, the preferred piston 31 has a stem 34 attached to one side and which extends with clearance through a bore 35 arranged to provide communication between the chamber 29 and a latching passage 36 provided for a purpose hereinafter described. A section of the piston 31 adjacent the stem 34 is provided with a series of grooves 37 which extend in the axial direction of the piston and function as flow passages when they are exposed to the escape port 28 —i.e., when the piston 31 is positioned as in FIGS. 4 and 5 of the drawings. Thus, the piston 31 arrives at the open position when the blind ends of the grooves 37 pass beyond the escape port 28 and thereby provide communication between the chamber 29 and the adjacent enlarged portion 38 of the passage part 21. Such communication is of course blocked immediately the piston 31 returns to a position in which the grooves 37 are completely at the chamber 29 side of the escape port 28 (e.g., see FIG. 3).

The stem 34 is also preferably provided with a number of axially extending grooves 39 at the end portion remote from the piston 31. Those grooves 39 are arranged to protrude into the chamber 29 (FIG. 4) when the grooves 37 are exposed to the port 28, and thereby increase the size of the flow passage defined between the stem 34 and the bore 35 so that a higher fluid flow rate can be attained. It is to be appreciated however, that the grooves 39 are not essential to proper functioning of the unit. Furthermore, it is not essential to have the escape port 28 at one end of the chamber 29, as it could connect with a side of that chamber as shown in the embodiment of FIG. 10 which will be hereinafter described in more detail.

Figure 3:
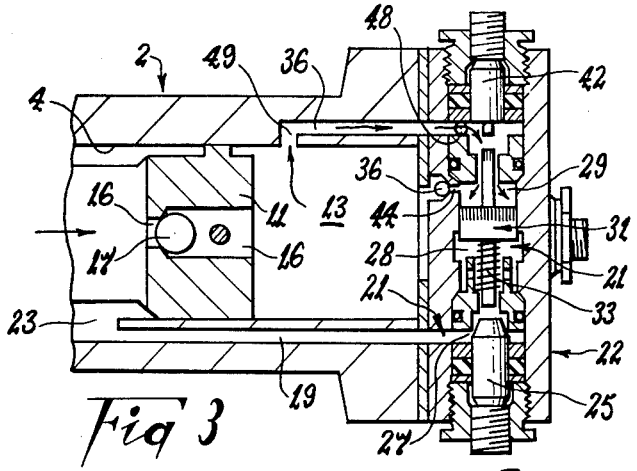
FIG. 3 is a view similar to FIG. 2 but showing the condition of the components when opening influence on the unit piston is removed and that piston is permitted to be urged back towards the door closed position under the influence of its biasing spring.

The arrangement is such that, in use, fluid pressure within the chamber 13 is reduced during opening movement of an associated door because of the movement of the piston 3 in the direction of arrow B in FIG. 1. In the course of that movement, the spring 14 is compressed so that when the restraining influence on the spindle 5 is released, the piston 3 is able to move in the door closing direction (arrow A in FIG. 19 under the influence of the spring 14 thereby causing an increase of fluid pressure within chamber 13. As a result of that pressure increase, the pressure acting on side 41 of the delay piston 31 is caused to exceed the influence of spring 33 and the piston 31 responds by moving towards the escape port 28 (FIG. 3). That movement continues so as to eventually expose at least part of the port 28 to the compartment inlet 32 through the main body of the compartment 29. The time taken for the piston 31 to travel from the rest position to the open position, is the delay time, and that time may be varied by adjusting means such as a stop screw which is adjustable to determine the rest position of the delay piston 31. In the form shown, the stem 34 of the piston 31 abuts against a slidable pin member 42 which in turn abuts a stop screw 43 when the piston 31 is in a rest position. The clearance between the piston stem 34 and bore 35 defines a bleed orifice through which fluid from the damping chamber 13 impinges on the piston 31 to move the piston 31 towards the open position.

When the main piston 3 of the closer is moved in a door opening direction (arrow B in FIG. 1), the pressure on the side 41 of the delay piston 31 is relieved. Escape of fluid from the inlet side of the compartment 29 may be facilitated through a relief passage 44 connected to the damping chamber 13, and a one-way ball valve 45 or other appropriate means is provided in the relief passage 44 to maintain it closed during door closing operation.

It is generally preferred to provide door closers with two closing speeds — i.e., a relatively slow initial speed and a faster latching speed for the last part (e.g. 10°) of the closing movement. That faster latching speed is effected in the embodiment shown by provision of a latching by-pass passage 36 similar to the by-pass passage (19, 21), but which is connected to the reservoir chamber 12 through the piston mid-section space 24 only when the piston 3 has reached a position at which there is only 10° (for example) of door closing movement remaining. A latching valve 46 (FIG. 9), similar in construction and operation to the aforementioned control valve 25, may be provided to regulate fluid flow through the latching by-pass 36.

In the particular form shown (in particular FIG. 9), an inlet passage 47 of the valve block 22 connects with the damping chamber 13 through the end face adjacent the piston section 11, and connects with the latching passage 36 through a branch passage 48 contained within the block 22. The latching valve 46 is arranged to control the rate of fluid flow between the passage 47 and 48. Because of its connection with the latching passage 36, the inlet passage 47 is necessarily placed in communication with the inlet side of the delay piston compartment 29. With such an arrangement, the delay piston 31 moves into its rest position when the latching by-pass 36 is open to fluid flow from the damping chamber 13 (see FIG. 9), since that flow causes a reduction in fluid pressure at the side 41 of the delay piston 31 (see FIG. 10).

It is to be appreciated that the invention may be applied to a closer unit having a single closing speed, in which event the latching by-pass passage 36 and associated valve 46 would be omitted from the construction previously described.

When the piston 31 starts its return movement from the open position to the rest position, there is a possibility that a partial vacuum will be created at the underside of the piston, especially in view of the restricted nature of the orifice 27 through which fluid would be drawn during that movement. As a precaution against that possibility. A valve controlled relief passage (see FIG. 5) may be provided to allow fluid from passage 9 to by-pass orifice 27 during the aforementioned return movement. A one-way ball valve 52 is provided in the construction shown, although any other appropriate form of control device may be used, and that valve is provided between the passage 51 and a port 53 which communicates with passage 21 at a position between the exhaust port 28 and the orifice 27. Passage 51 communicates with passage 21 at a position between orifice 27 and passage 19.

During movement of the piston 31 towards the open position, pressurized fluid in passage part 38 passes through the valve port 53 and urges valve 52 into a closed position against seat 54 thereby restricting exhaust of fluid to the orifice 27. During reverse movement of the piston 31, the ball valve 52 will normally remain closed if full pressure is maintained against the lower face of piston 31. In the event that a partial vacuum occurs however, the resulting pressure drop will cause a reduction in the closing influence on valve 52 and the higher pressure in passage 51 will cause the valve to open and thereby result in equalization of the pressures in passages 19 and the area immediately below piston 31.

For convenience of installation and maintenance, the valve 52 is preferably part of a replaceable capsule 55 as shown in FIG. 5, and that capsule is held in place by a retaining screw 56.

FIG. 10 shows in diagrammatic form an alternative arrangement of the valve block in which parts corresponding to those of the previous embodiment are identified by like reference numbers except they are in the series 100–199. The main difference between the FIG. 10 embodiment and the previous embodiment is that the escape port 128 is at one side of the compartment 129 rather than at an end of that compartment. In the open position of the piston 131, the end face 141 of the piston is located below the upper edge of the port 128 so that communication between chamber 113 and the passage (119, 121) is effected. In the drawing however, the embodiment of FIG. 10 is shown in the condition adopted when the piston 103 is in the early stage of movement in the door opening direction, and in that condition the pressure acting against face 141 of piston 131 is relieved so that the spring 133 is able to push the piston 131 back into the rest position. It will be seen that fluid is able to escape from above the piston 131 through both passages 144 and 136. The same result of course occurs in the embodiment of FIGS. 1–9.

Referring now to FIGS. 1–9, operation of that embodiment is as follows. When the piston 3 is moved in the door opening direction (arrow B in FIG. 1) fluid is transferred from the reservoir chamber 12 through the space 24 and piston passage 16, into the damping chamber 13. The pressure on the end face 41 of piston 31 is relieved through both passages 44 and 36 (see FIG. 2).

When the piston 3 commences to move in a door closing direction, as shown in FIG. 3, the fluid in chamber 13 is pressurized and seeks to escape through passages 36 and 44. Passage 44 is blocked however, by the one-way valve 45, and fluid from passage 36 enters into the compartment 29 through bore 35 and impinges against the end face 41 of the piston 31. The piston 31 blocks passage of fluid to the escape port 28 so that piston 3 remains substantially stationary against the pressurized fluid barrier in the chamber 13. As the pressure against the piston face 41 is higher than the restraining influence of the spring 33, piston 31 starts to move downwards towards port 28, and the speed of that movement is controlled by the adjusted position of the valve 25. That is, valve 25 restricts escape of fluid from beneath the piston 31 to the by-pass passage 19 and thence to the lower pressure side of piston 3.

Under the conditions existing in FIG. 3, pressure within the chamber 13 cannot be relieved through the inlet passage 47 to the valve block 22. Fluid entering the block 22 through passage 47 can find escape from the block 22 only by way of the passage 36 (so long as piston 31 blocks escape port 28) and the opening 49 of the passage 36 is, at the FIG. 3 position, exposed directly to the chamber 13.

FIGS. 4 and 5 show the piston 31 in the open position at which the grooves 37 are exposed to the port 28, and fluid is then able to bleed from the compartment 29 into the passage part 38 for escape through the orifice 27 and passage 19 to the low pressure side of piston 3. The piston 3 is then able to move towards the door closed position, and during that movement pressure is maintained against face 41 of the piston 31 so that the piston remains in the open position.

Figure 9:
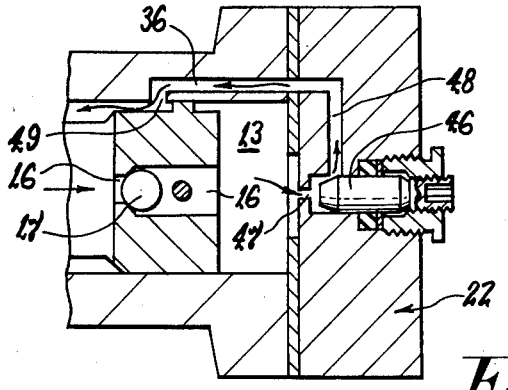
FIG. 9 is a cross-sectional view taken along line IX—IX of FIG. 8 and showing the unit progressed beyond the condition shown in FIG. 4 so as to be further towards the fully closed position.

When closing movement of the piston 3 advances to the position shown in FIG. 9, the opening 49 of passage 36 is exposed to the low pressure side of the piston 3 through the space 24 behind piston section 11. The rate of exhaust of fluid from the chamber 13 is thereby increased - that is, fluid entering the block 22 through inlet 47 escapes through both by-pass passages (19, 21) and 36, whereas in the FIG. 4 position for example, the former passage only provides an escape route.

One advantage of the FIGS. 1–9 embodiment over that of FIG. 10, is the comparative simplicity in forming the various passages in the valve block 22. In particular, manufacture is simplified by the provision of a throughbore which defines both the compartment 29 and the passage 21, and the use of bushes within that bore to provide the necessary restrictions and bearing surfaces.

It will be appreciated from the foregoing description that the present invention provides an improvement over the prior art constructions in that the delay means is simple and effective in operation. A particular advantage of the improved construction is that the delay is time dependent, and the delay time can be adjusted. A further advantage is that the delay piston is pressure responsive so that it will move to the open position if a substantial pressure is applied to the door to which the closer is connected, whereas in prior art constructions a special relief valve was required to guard against damage in the event of application of greater than normal pressures.

Finally, it is to be understood that various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. A door closer including; a hollow body; a body piston slidably mounted in said body and dividing the interior thereof into a damping chamber and a reservoir chamber, the respective volumes of which vary with axial movement of said body piston relative to said body; first biasing means urging said body piston in a direction to reduce the volume of said damping chamber; escape means through which fluid can be bled from said damping chamber to permit said body piston to move in said direction, including an escape conduit and a compartment having an inlet which communicates with said damping chamber through said escape conduit so as to receive said fluid therefrom, at least in some positions of said body piston relative to said damping chamber, and an escape port through which said fluid received from said damping chamber can be discharged; closure means controlling opening and closing of said escape port and being mounted within said compartment for movement between a rest position and an escape port opening position, said positions being spaced apart and said escape port being maintained closing while said closure means travels between said positions; and second biasing means urging said closure means into said rest position; said closure means being responsive to the pressure of fluid received through said inlet to move towards said escape port opening position against said second biasing means, when said pressure exceeds the influence of said second biasing means on said closure means; whereby a time delay occurs in the opening of said escape port while said closure means moves between said rest position and said escape port opening position.

2. A door closer according to claim 1, wherein said compartment and said closure means are provided within a member which is detachably secured to said body to form an end wall of said damping chamber.

3. A door closer according to claim 1, wherein said escape port is connected to said reservoir chamber through a bypass passage including a bypass valve which restricts the rate of flow of fluid between said escape port and said reservoir chamber, and said bypass valve is adjustable to regulate said rate of flow.

4. A door closer according to claim 1, wherein said closure means is in the form of a closure piston slidably, sealingly mounted within said compartment wherein said inlet is located at one side of said closure piston and wherein said escape port is located at a position adjacent the other side of the closure piston, when said closure piston is in the rest position.

5. A door closer according to claim 4, wherein the escape port is exposed to said one side of the closure piston at said escape port opening position, and the distance travelled by said closure piston in moving from the rest position to the escape port opening position is a controlling parameter in the period of said time delay.

6. A door closer according to claim 5, wherein said escape conduit further includes a stop and wherein said distance is variable by adjusting said stop which is engageable by said closure piston and determines the location of said rest position relative to said escape port.

7. A door closer including; a hollow body; a body piston slidably mounted in said body and dividing the interior thereof into a damping chamber and a reservoir chamber, the respective volumes of which vary with axial movement of said body piston relative to said body; first biasing means urging said body piston in a direction to reduce the volume of said damping chamber; escape means through which fluid can be bled from said damping chamber to permit said body piston to move in said direction, including an escape conduit and a compartment having an inlet which communicates with said damping chamber through said escape conduit so as to receive said fluid therefrom, at least in some positions of said body piston relative to said damping chamber, and an escape port through which said fluid received from said damping chamber can be discharged; closure means mounted within said compartment for movement between a rest position and an escape port opening position, and urged by a second biasing means into said rest position to thereby block fluid communication between said inlet and said escape port; said closure means being responsive to the fluid pressure within said damping chamber, which is communicated to it by said escape conduit and said inlet, to move against the influence of said second biasing means in a direction toward said escape port so as to adopt said escape port opening position; said escape port being maintained closed while said closure means travel between said positions, and said escape port being at least partially opened at said escape port opening position to permit fluid communication between said inlet and said escape port; the time taken by said closure means to move the distance from said rest position to said escape port opening position being determined relative to the rate of flow of fluid through said inlet to thereby achieve a desired time delay between the pressurization of fluid within said damping chamber by action of said piston means and the arrival of said closure means at said escape port opening position.

8. A door closer according to claim 7, wherein said escape conduit includes adjusting means to vary the location of said rest position relative to said escape port, and thereby varying said time delay.

9. A door closer according to claim 7, wherein said closure means comprises a closure piston which is slidably, sealingly mounted in said compartment, wherein said inlet is located to one side of said closure piston, and said escape port connects with said compartment at a location remote from said inlet and adjacent the side of said closure piston opposite said one side thereof when said closure piston is in said rest position.

10. A door closer according to claim 9, wherein said compartment is cylindrical and said escape port is defined by one end of said compartment, and said closure piston has a plurality of grooves formed in its outer cylindrical surface and extending from said one side thereof towards but terminating before said side of said closure piston opposite said one side thereof, said one side being adjacent said inlet, and said grooves serving to provide communication from said inlet and said one side to said escape port when the closure piston is in said escape port opening position.

11. A door closer according to claim 7, wherein said escape port is connected to said reservoir chamber through a bypass passage which includes a restrictor and the fluid flow rate through said bypass passage is limited by means of said restrictor.

12. A door closer according to claim 11, wherein a relief passage is connected between said bypass passage, on said reservoir chamber side of said restrictor, and said escape port so as to bypass said restrictor, and a relief valve is provided in said relief passage to open when fluid pressure on the escape port side of said restrictor falls below the fluid pressure on said reservoir chamber side of said restrictor and to close when fluid pressure on the escape port side of said restrictor is greater than the fluid pressure on said reservoir chamber side of said restrictor.

13. A door closer according to claim 11, wherein said restrictor comprises an adjustable bypass valve which is located within one end of a valve block bore extending completely through a valve block, said valve block being releasably secured to one end of said body and defining an end wall of said damping chamber, said closure means is slidably, sealingly mounted within said compartment, which comprises a portion of said valve block bore, which compartment has said inlet at one end and said escape port is connected thereto at the opposite end of the compartment which is the end thereof adjacent said bypass valve, and an adjustable stop is provided in the end of said valve block bore remote from said bypass valve and projects through said inlet to engage said closure means to thereby determine the rest position of said closure means.

14. A door closer including; a hollow body; a body piston slidably mounted in said body and dividing the interior thereof into a damping chamber and a reservoir chamber, the respective volumes of which vary with axial movement of said body piston relative to said body; first biasing means urging said body piston in a direction to reduce the volume of said damping chamber; escape means through which fluid can be bled from said damping chamber to permit said body piston member to move in said direction, including an escape conduit and a compartment having an inlet which communicates with said damping chamber through said escape conduit so as to receive said fluid therefrom, at least in some positions of said body piston member relative to said damping chamber, and an escape port through which said fluid received from said damping chamber can be discharged; closure means mounted within said compartment for movement between a rest position and an escape port opening position, and urged by a second biasing means into said rest position to thereby block fluid communication between said inlet and said escape port; said closure means being responsive to the fluid pressure within said damping chamber, which is communicated to it by said escape conduit and said inlet, to move against the influence of said second biasing means in a direction toward said escape port so as to adopt said escape port opening position; said escape port being maintained closed while said closure means travel between said positions, and said escape port being at least partially opened at said escape port opening position to permit fluid communication between said inlet and said escape port; the time taken by said closure means to move the distance from said rest position to said escape port opening position being determined relative to the rate of flow of fluid through said escape port to thereby achieve a desired time delay between the pressurization of fluid within said damping chamber by action of said piston means and the arrival of said closure means at said escape port opening position.

* * * * *